US009279259B1

(12) United States Patent
Russo

(10) Patent No.: US 9,279,259 B1
(45) Date of Patent: Mar. 8, 2016

(54) TILE LIPPAGE REMOVAL SYSTEM

(71) Applicant: William P. Russo, Hartford, WI (US)

(72) Inventor: William P. Russo, Hartford, WI (US)

( * ) Notice: Subject to any disclaimer, the term of this patent is extended or adjusted under 35 U.S.C. 154(b) by 0 days.

(21) Appl. No.: 14/823,085

(22) Filed: Aug. 11, 2015

Related U.S. Application Data

(63) Continuation-in-part of application No. 14/718,131, filed on May 21, 2015.

(51) Int. Cl.

| | |
|---|---|
| ***E04F 21/20*** | (2006.01) |
| ***E04F 21/00*** | (2006.01) |
| ***E04F 21/22*** | (2006.01) |
| ***E04F 21/18*** | (2006.01) |
| ***E04F 15/02*** | (2006.01) |
| ***E04G 21/00*** | (2006.01) |

(52) U.S. Cl.
CPC ..... *E04F 21/20* (2013.01); *E04F 15/02005* (2013.01); *E04F 21/0092* (2013.01); *E04F 21/1877* (2013.01); *E04F 21/22* (2013.01); *E04G 21/00* (2013.01)

(58) Field of Classification Search
CPC . E04F 21/0092; E04F 21/22; E04F 15/02005; E04F 21/00; E04F 21/20; E04F 21/02022; E04G 21/00; Y10S 33/20; Y10S 52/01; G01B 5/285; F16B 37/00; F16B 37/16; F16B 11/006
USPC ..... 52/747.11, 749.11, 126.7, 389, DIG. 1, 52/126.1, 127.7, 126.6, 127.3; D8/354; 248/188.4, 354.3; 249/192; 33/533, 33/526, 527; 411/82, 435, 427
See application file for complete search history.

(56) References Cited

U.S. PATENT DOCUMENTS

| | | | | |
|---|---|---|---|---|
| 3,552,257 | A * | 1/1971 | Tanabe | F16B 37/16 411/368 |
| 3,961,453 | A * | 6/1976 | Couwenbergs | E04D 11/005 52/126.1 |
| 4,024,683 | A * | 5/1977 | Kilian | E04F 21/0092 52/127.3 |
| 4,397,125 | A * | 8/1983 | Gussler, Jr. | E04F 21/22 52/127.3 |
| 7,257,926 | B1 * | 8/2007 | Kirby | E04F 15/02005 33/526 |
| 7,621,100 | B2 * | 11/2009 | Kufner | E04F 13/0892 33/526 |
| 7,861,487 | B2 * | 1/2011 | Kufner | E04F 15/02005 33/526 |
| 8,079,199 | B1 * | 12/2011 | Kufner | E04F 13/0892 33/526 |
| 8,181,420 | B2 * | 5/2012 | Torrents I Comas | E04F 21/0092 52/127.7 |
| 8,336,279 | B2 * | 12/2012 | Kufner | E04F 15/02005 33/526 |

(Continued)

FOREIGN PATENT DOCUMENTS

| | | | | |
|---|---|---|---|---|
| AU | WO 2014022889 | A1 * | 2/2014 | E04F 21/0092 |
| IT | 2549030 | A2 * | 1/2013 | E04F 21/0092 |

*Primary Examiner* — Robert Canfield
*Assistant Examiner* — Matthew Gitlin
(74) *Attorney, Agent, or Firm* — Donald J. Ersler

(57) ABSTRACT

A tile lippage removal system preferably includes a spacer post, a threaded cap and an anti-friction protection plate. The spacer post includes a base member, a spacer member and a threaded shaft. A bottom of the spacer member extends from a top of the base member. A break away connection is made between the spacer member and the base member. A bottom of the threaded shaft extends from a top of the spacer member. A plurality of grip extensions extend from an outer surface of a substantial inverted cup to allow rotation of the threaded cap. A female thread is formed in a center of the substantial inverted cup to threadably receive the threaded shaft. The anti-friction protection plate includes a round outer perimeter and a spacer opening, which is sized to receive the spacer member. The anti-friction protection plate may be used to improve existing tile lippage removal systems.

14 Claims, 9 Drawing Sheets

(56) References Cited

U.S. PATENT DOCUMENTS 8,635,815 B2 * 1/2014 Bordin ..... E04F 21/0092 33/526

8,950,079 B2 * 2/2015 Hillebrandt ..... E04F 15/02005 33/527

2015/0211243 A1 * 7/2015 Irvine ..... E04F 21/0092 52/126.1

* cited by examiner

TILE LIPPAGE REMOVAL SYSTEM

CROSS-REFERENCES TO RELATED APPLICATIONS

This is a continuation-in-part patent application taking priority from patent application Ser. No. 14/718,131 filed on May 21, 2015.

BACKGROUND OF THE INVENTION

1. Field of the Invention

The present invention relates generally to tiles and more specifically to a tile lippage removal system, which provides only a downward force for laying tiles.

2. Discussion of the Prior Art

U.S. Pat. No. 7,992,354 to Doda Jr. discloses a device for leveling and aligning tiles and method for leveling and aligning tiles. U.S. Pat. No. 8,635,815 to Brodin discloses a leveling spacer for laying wall tiles, paving tiles and the like with the interposition of gaps. However, both of the above tile aligning devices and others similar to them, do not only apply downward force, but also apply a component of lateral force. The lateral force has the tendency to spread the tiles away from each other, such that the tile edges are no longer parallel to each other. Non-parallel edges between tiles are not acceptable. Additionally, a device that moves relative to a tile surface to apply downward pressure will also mar the tile surface. Finally, any lateral movement of the tiles relative to each other will cause tile glue to ooze out.

Accordingly, there is a clearly felt need in the art for a tile lippage removal system, which provides only a downward force for laying tiles; does not mar a top of the tiles; and prevents oozing of tile glue.

SUMMARY OF THE INVENTION

The present invention provides a tile lippage removal system, which does not mar a top of the tiles. The tile lippage removal system preferably includes a spacer post, a threaded cap and an anti-friction protection plate. The spacer post includes a base member, a spacer member and a threaded shaft. A bottom of the spacer member extends from a top of the base member. A break away connection is formed between the spacer member and the base member. A bottom of the threaded shaft extends from a top of the spacer member. The threaded cap preferably includes a substantial inverted cup and a plurality of grip extensions. The plurality of grip extensions extend from an outer surface of the substantial inverted cup to allow rotation of the threaded cap. A female thread is formed in a center of the substantial inverted cup to threadably receive the threaded shaft. The anti-friction protection plate preferably includes a round outer perimeter and a spacer opening that is sized to receive an outer perimeter of the spacer post and the threaded shaft. The anti-friction protection plate may be added to existing tile lippage removal systems with round threaded caps. The anti-friction protection plate would have an outer diameter, which is greater than that of the threaded cap and a spacer opening. The anti-friction protection plates for wedge type tile lippage removal systems would have a rectangular perimeter shape and a spacer opening that is sized to receive an outer perimeter of the spacer post. The anti-friction protection plate does not move laterally relative to the two adjacent tiles. The anti-friction protection plate is preferably fabricated from a clear or translucent material.

Accordingly, it is an object of the present invention to provide a tile lippage removal system, which provides only a downward force for laying tiles.

It is a further object of the present invention to provide a tile lippage removal system, which does not mar a top of the tiles.

Finally, it is another object of the present invention to provide a tile lippage removal system, which prevents oozing of tile glue.

These and additional objects, advantages, features and benefits of the present invention will become apparent from the following specification.

DETAILED DESCRIPTION OF THE PREFERRED EMBODIMENTS

Figure 1:
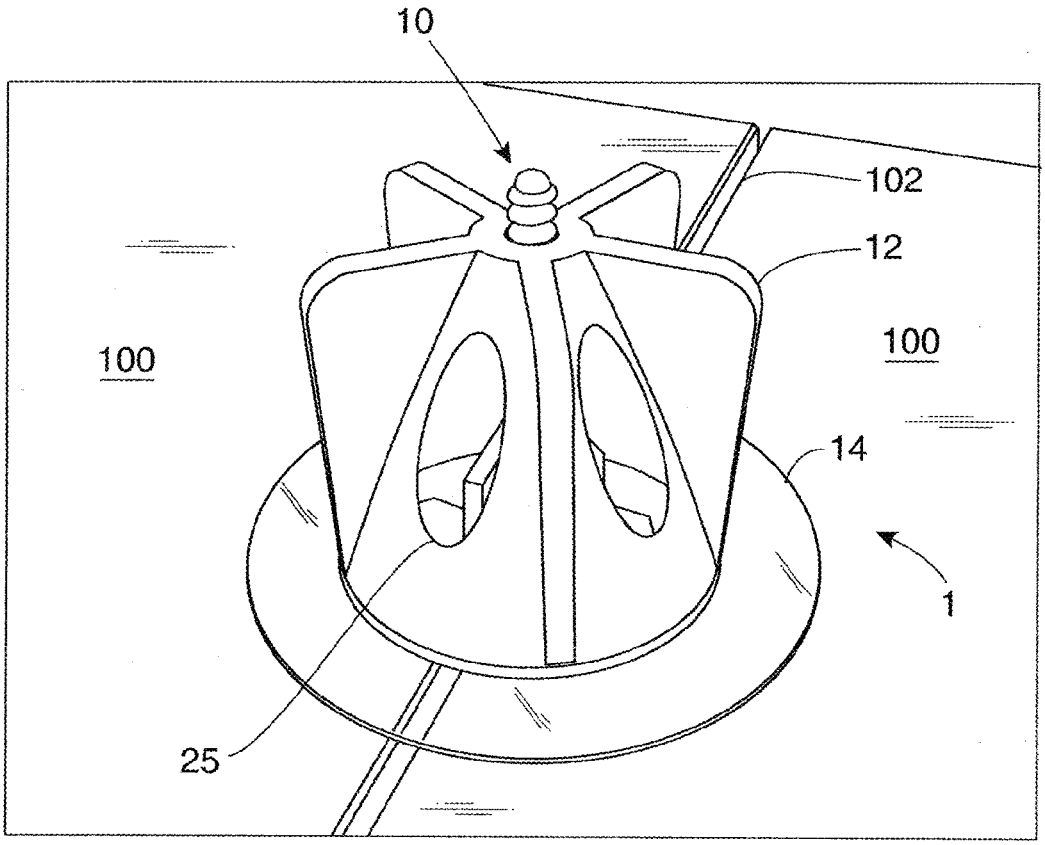
FIG. 1 is a perspective view of a tile lippage removal system retaining two adjacent tiles in accordance with the present invention.
Figure 2:
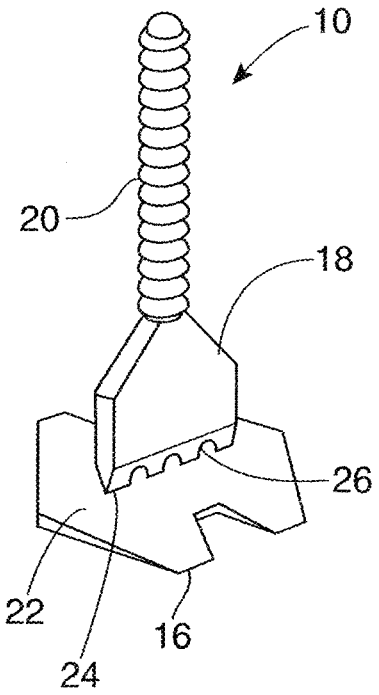
FIG. 2 is a perspective view of a spacer post of a tile lippage removal system in accordance with the present invention.
Figure 3:
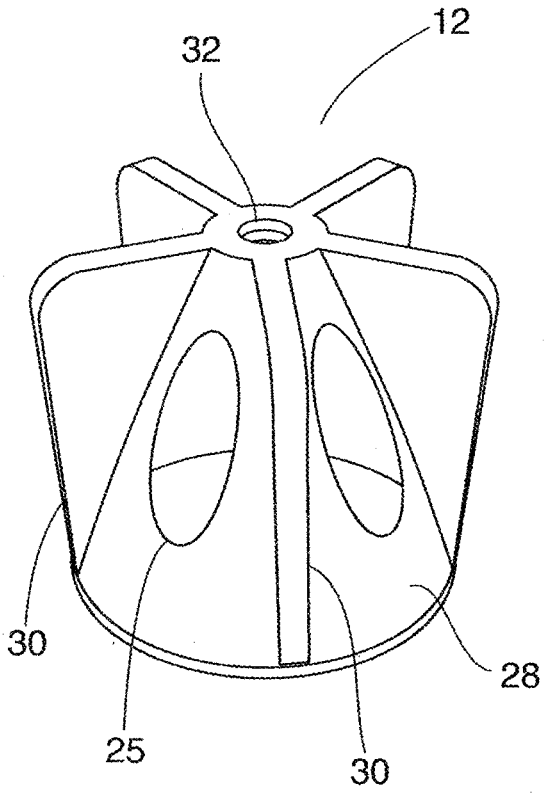
FIG. 3 is a perspective view of a threaded cap of a tile lippage removal system in accordance with the present invention.
Figure 4:
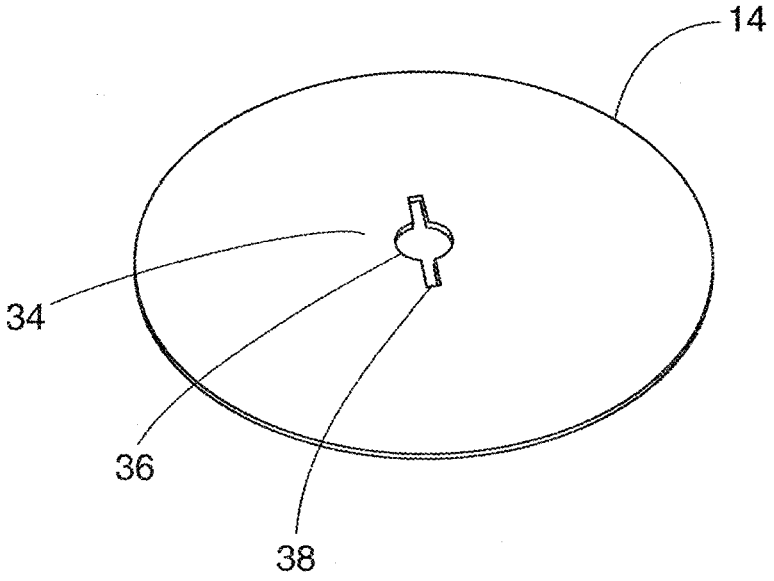
FIG. 4 is a perspective view of an anti-friction protection plate of a tile lippage removal system in accordance with the present invention.

With reference now to the drawings, and particularly to FIG. 1, there is shown a perspective view of a tile lippage removal system 1. With reference to FIGS. 2-4, the tile lippage removal system 1 preferably includes a spacer post 10, a threaded cap 12 and an anti-friction protection plate 14. The spacer post 10 includes a base member 16, a spacer member 18 and a threaded shaft 20. The base member 16 may have any suitable shape. A bottom of the spacer member 18 extends from a top of the base member 16. A break away connection 22 is made between the spacer member 18 and the base member 16. The break away connection 22 preferably includes a spacer member 18 with a reduced web 24 and a plurality of openings 26. The break away connection 22 allows the spacer member 18 to be separated from the base member 16 by kicking the spacer member 18 with a shoe. The spacer member 18 has a thickness, which is less than a gap 102 between two adjacent tiles 100. A bottom of the threaded shaft 20 extends from a top of the spacer member 16.

Figure 3A:
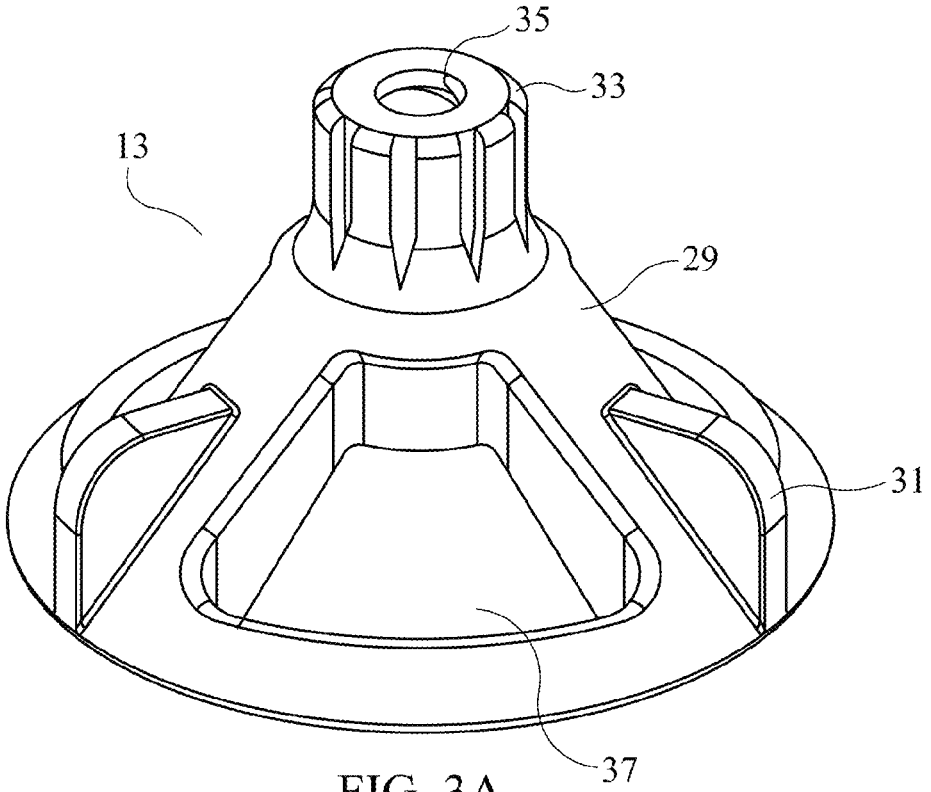
FIG. 3*a* is a top perspective view of an alterative design of a threaded cap of a tile lippage removal system in accordance with the present invention.
Figure 3B:
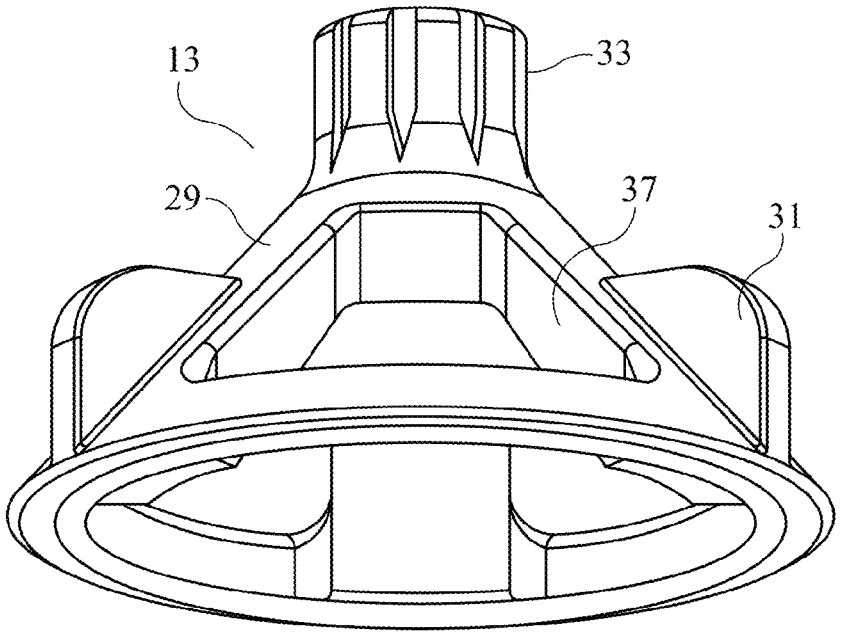
FIG. 3*b* is a top perspective view of an alterative design of a threaded cap of a tile lippage removal system in accordance with the present invention.

The threaded cap 12 preferably includes a substantial inverted cup 28 and a plurality of grip extensions 30. The plurality of grip extensions 30 extend from an outer surface of the substantial inverted cup 28 to allow rotation of the threaded cap 12. A female thread 32 is formed in a center of the substantial inverted cup 28 to threadably receive the threaded shaft 20. A plurality of sight openings 25 are formed through the substantial inverted cup 28. With reference to FIGS. 3*a*-3*b*, an alternative design of a threaded cap 13 preferably includes a substantial inverted cup 29 and a plurality of grip extensions 31. A hub 33 extends from a top of the substantial inverted cup 29. A female thread 35 is formed through a center of the hub 33 to threadably receive the threaded shaft 20. A plurality of sight openings 37 are formed through the substantial inverted cup 29 to form a plurality of ribs 43. The plurality of grip extensions 31 extend from said plurality of ribs 43 to allow rotation of the threaded cap 13.

Figure 4A:
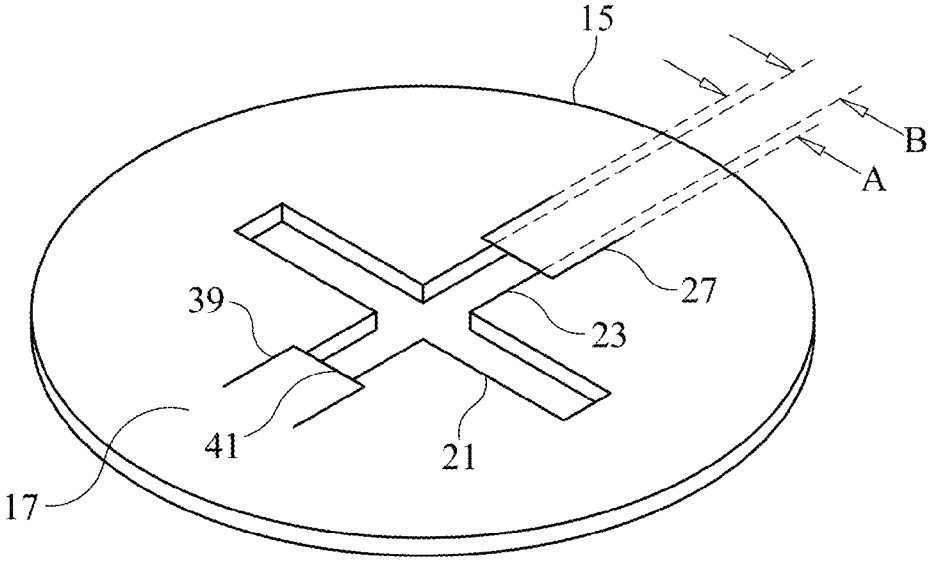
FIG. 4*a* is a perspective view of a universal anti-friction protection plate of a tile lippage removal system in accordance with the present invention.
Figure 4B:
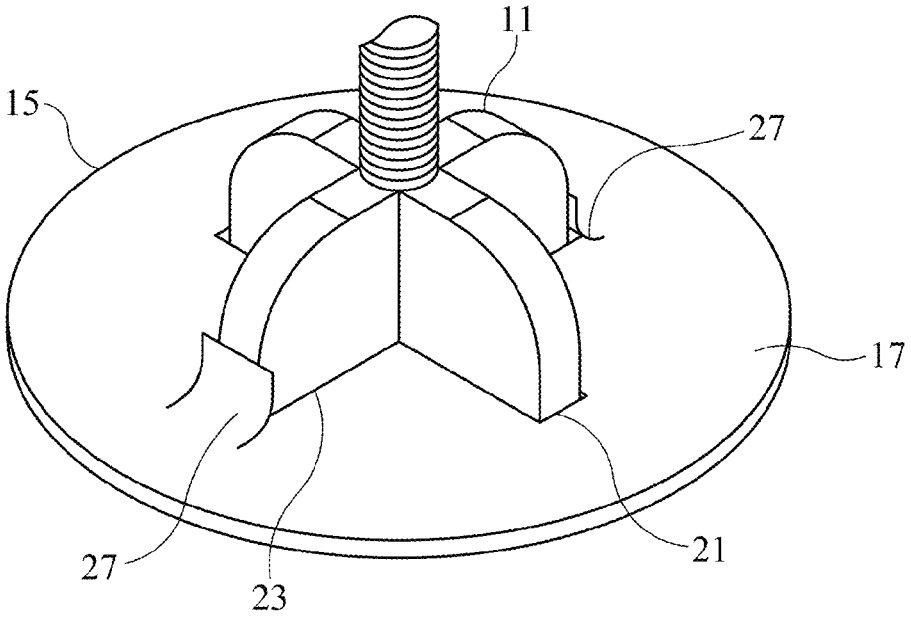
FIG. 4*b* is a perspective view of a universal anti-friction protection plate with a spacer post inserted therethrough of a tile lippage removal system in accordance with the present invention.
Figure 4C:
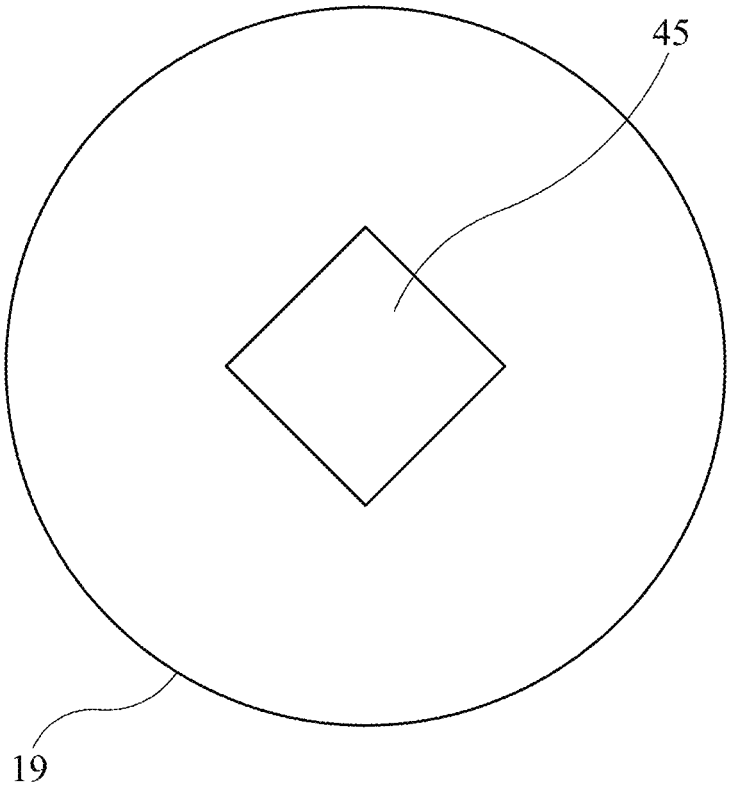
FIG. 4*c* is a top view of an anti-friction protection plate with a square shaft opening of a tile lippage removal system in accordance with the present invention.

The anti-friction protection plate 14 preferably includes a round outer perimeter and a spacer opening 34. The spacer opening 34 includes a threaded shaft opening 36 and a spacer member opening 38. With reference to FIG. 4*a*, a universal anti-friction protection plate 15 preferably includes a round outer perimeter and a spacer opening 17. The spacer opening 17 includes a lateral slot 21, a lateral cross-slot 23. The lateral slot 21 is substantially perpendicular to the lateral cross-slot 23. The lateral cross-slot 23 crosses the lateral slot 21. Each end of the lateral cross-slot 23 is terminated with a flap member 27. A width "A" of the flap member 27 is about twice a width "B" of the lateral cross-slot 23. The flap member 27 is created in the universal anti-friction protection plate 15 by making two substantially parallel cuts 39, which are parallel to the lateral cross-slot 23 and an end cut 41 to define an end of the lateral cross-slot 23. With reference to FIG. 4*b*, a spacer post 11 is inserted through the spacer opening 17. With reference to FIG. 4*c*, an anti-friction protection plate 19 preferably includes a round outer perimeter and a rectangular threaded shaft opening 45.

Figure 5:
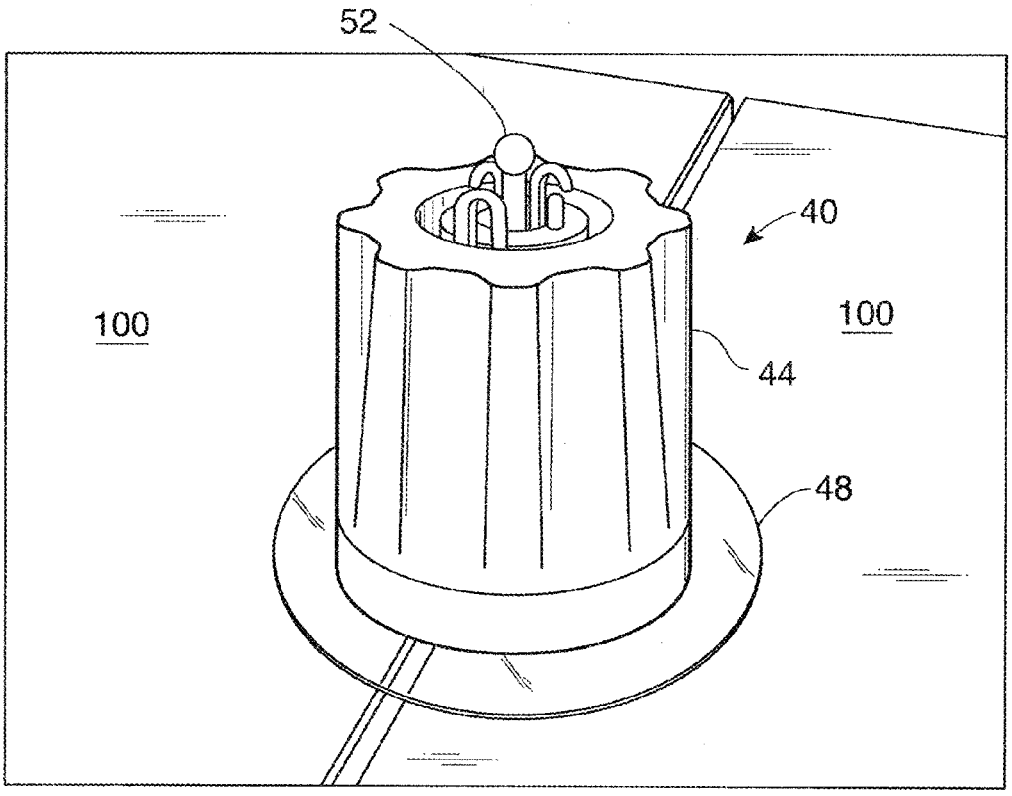
FIG. 5 is a perspective view of an existing tile lippage removal system with a round threaded cap and an anti-friction protection plate.
Figure 6:
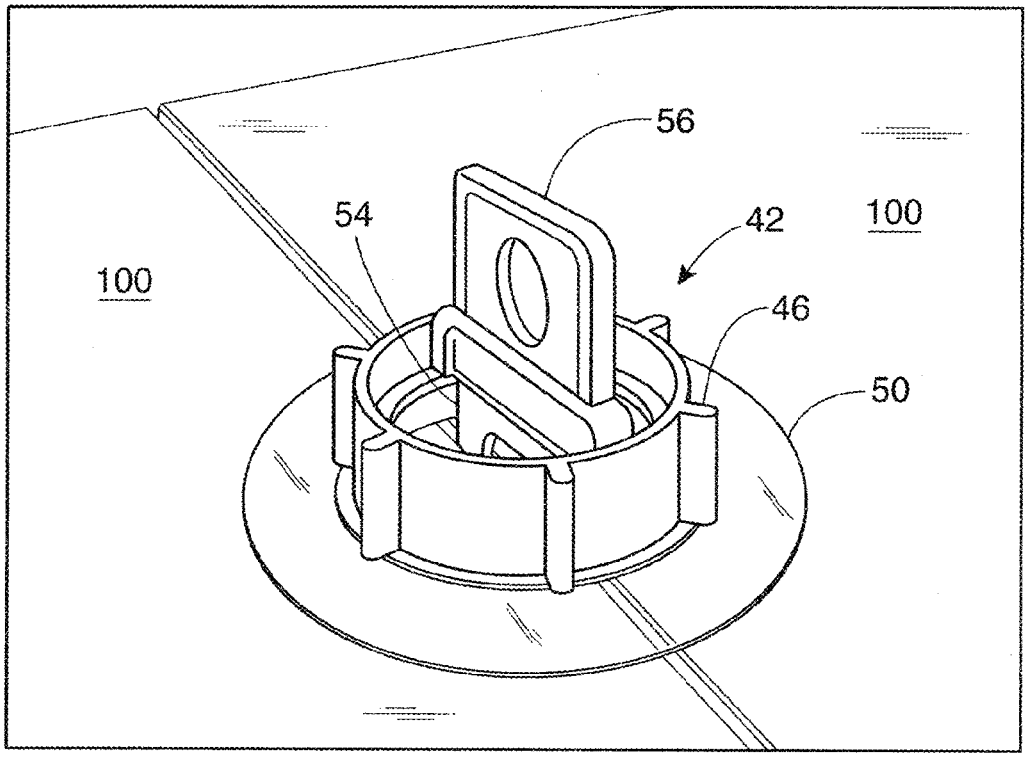
FIG. 6 is a perspective view of a second existing tile lippage removal system with a round threaded cap and an anti-friction protection plate.
Figure 7:
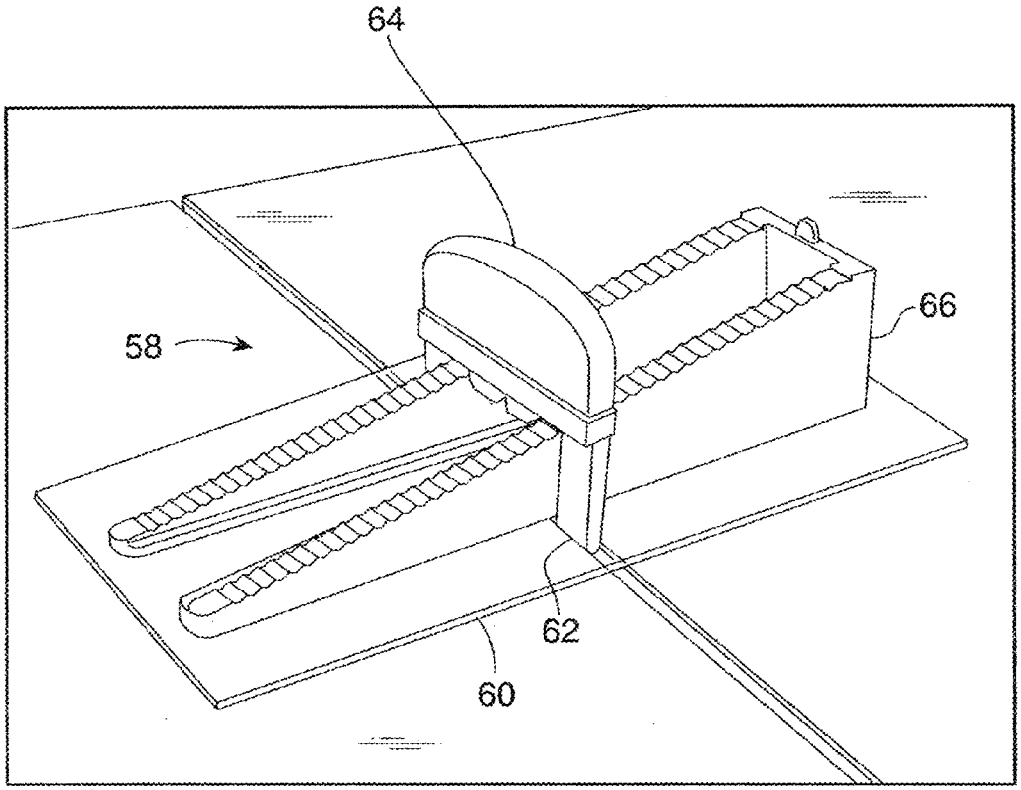
FIG. 7 is a perspective view of a wedge type existing tile lippage removal system with an anti-friction protection plate.

With reference to FIGS. 5-6, an anti-friction protection plate 48 may be added to existing tile lippage removal systems 40, 42 with round threaded caps 44, 46, respectively. With reference to FIG. 5, an anti-friction protection plate 48 for the round threaded cap 44 would have an outer diameter, which is greater than that of the threaded cap 44. A spacer opening and a threaded shaft opening are formed through the anti-friction protection plate 48 to provide clearance for a spacer member 52. With reference to FIG. 6, an anti-friction protection plate 50 for the round threaded cap 44 would have an outer diameter, which is greater than that of the threaded cap 46. A spacer opening 54 is formed through the anti-friction protection plate 50 to provide clearance for a spacer member 56. With reference to FIG. 7, an anti-friction protection plate 60 for a wedge type tile lippage removal system 58 includes a rectangular perimeter shape and a spacer opening 62 that is sized to receive an outer perimeter of a spacer member 64. A wedge block 66 is retained in the spacer member 64. The round threaded caps 44, 46 and the wedge 66 are hold down devices. The anti-friction protection plates 14, 15, 48, 50, 60 do not move laterally relative to the two adjacent tiles 100. The anti-friction protection plates 14, 15, 19, 48, 50 and 60 are preferably fabricated from a clear or translucent material. The combination of the translucent or clear anti-friction protection plates 14, 15 and 19 and the plurality of sight openings 25, 37 allow a distance between the two adjacent tiles 100 to be viewed through the threaded cap 12, 13.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A tile lippage removal system comprising:

a spacer post includes a base member, and a threaded shaft, a bottom of said threaded shaft extends from a top of said base member; and a threaded cap includes a substantially cone shaped portion having an inverted orientation and a hub, a plurality of sight openings are formed through said cone shaped portion to form a plurality of ribs, said plurality of ribs are disposed between said plurality of sight openings, a plurality of grip extensions extend from said plurality of ribs, said hub extends from a top of said substantial cone shaped portion, a female thread is formed through a center of said hub a plurality of grip portions are formed on a perimeter of said hub, said female thread is sized to threadably receive said threaded shaft.

2. A tile lippage removal system of claim 1 wherein:

a break away connection is formed between said base member and said threaded shaft.

3. A tile lippage removal system of claim 1 wherein:

an anti-friction protection plate includes a spacer opening that is sized to receive an outer perimeter of said spacer post and said threaded shaft.

4. The tile lippage removal system of claim 3 wherein:

said anti-friction protection plate includes a round outer perimeter.

5. The tile lippage removal system of claim 3 wherein:

said anti-friction plate is fabricated from one of a clear and translucent material.

6. A tile lippage removal system comprising:

a spacer post includes a base member, a spacer member and a threaded shaft, a bottom of said spacer member extends from a top of said base member, a bottom of said threaded shaft extends from a top of said spacer member; and a threaded cap includes a substantially cone shaped portion having an inverted orientation and a hub, a plurality of sight openings are formed through said cone shaped portion to form a plurality of ribs, said plurality of ribs are disposed between said plurality of sight openings, said hub extends from a top of said substantial cone shaped portion, a female thread is formed through a center of said hub, a plurality of grip portions are formed on a perimeter of said hub, said female thread is sized to threadably receive said threaded shaft.

7. A tile lippage removal system of claim 6 wherein:

a break away connection is formed between said base member and said threaded shaft.

8. A tile lippage removal system of claim 6 wherein:

an anti-friction protection plate includes a spacer opening that is sized to receive an outer perimeter of said spacer post and said threaded shaft.

9. The tile lippage removal system of claim 8 wherein:

said anti-friction protection plate includes a round outer perimeter.

10. The tile lippage removal system of claim 8 wherein:

said anti-friction plate is fabricated from one of a clear and translucent material.

11. A tile lippage removal system comprising:

a spacer post includes a base member, a spacer member and a threaded shaft, a bottom of said spacer member extends from a top of said base member, a break away connection is formed in said spacer member adjacent said base member, a bottom of said threaded shaft extends from a top of said spacer member, a plurality of spacer openings are formed through a junction of said spacer member and said base member; and a threaded cap includes a substantially cone shaped portion having an inverted orientation and a hub, a plurality of sight openings are formed through said cone shaped portion to form a plurality of ribs, said plurality of ribs are disposed between said plurality of sight openings, a plurality of grip extensions extend from said plurality of ribs, said hub extends from a top of said substantial cone shaped portion, a female thread is formed through a center of said hub, a plurality of grip portions are formed on a perimeter of said hub, said female thread is sized to threadably receive said threaded shaft.

12. A tile lippage removal system of claim 11 wherein:

an anti-friction protection plate includes a spacer opening that is sized to receive an outer perimeter of said spacer post and said threaded shaft.

13. The tile lippage removal system of claim 12 wherein:

said anti-friction protection plate includes a round outer perimeter.

14. The tile lippage removal system of claim 12 wherein:

said anti-friction plate is fabricated from one of a clear and translucent material.

* * * * *